US009966009B2

(12) United States Patent
Numata et al.

(10) Patent No.: US 9,966,009 B2
(45) Date of Patent: May 8, 2018

(54) DISPLAY DEVICE

(71) Applicant: Japan Display Inc., Tokyo (JP)

(72) Inventors: Yuuichi Numata, Tokyo (JP); Takahiro Fujioka, Tokyo (JP); Kazuhiro Odaka, Tokyo (JP); Hiroyuki Kimura, Tokyo (JP)

(73) Assignee: Japan Display Inc., Tokyo (JP)

( * ) Notice: Subject to any disclaimer, the term of this patent is extended or adjusted under 35 U.S.C. 154(b) by 82 days.

(21) Appl. No.: 15/259,529

(22) Filed: Sep. 8, 2016

(65) Prior Publication Data

US 2017/0076667 A1 Mar. 16, 2017

(30) Foreign Application Priority Data

Sep. 11, 2015 (JP) ..... 2015-179304

(51) Int. Cl.
*G09G 5/00* (2006.01)
*G09G 3/3266* (2016.01)
*G09G 3/3258* (2016.01)

(52) U.S. Cl.
CPC ..... *G09G 3/3266* (2013.01); *G09G 3/3258* (2013.01); *G09G 2300/0426* (2013.01); *G09G 2310/0291* (2013.01)

(58) Field of Classification Search
CPC .. G09G 3/3233; G09G 3/3266; G09G 3/3258; H01L 27/3246
USPC ..... 345/212, 690
See application file for complete search history.

(56) References Cited

U.S. PATENT DOCUMENTS 8,564,508 B2 * 10/2013 Uchino ..... G09G 3/3233 345/78
2013/0162622 A1 * 6/2013 Ebisuno ..... G09G 3/3208 345/212

FOREIGN PATENT DOCUMENTS

JP H11-119240 A 4/1999
JP 2015-072761 A 4/2015

* cited by examiner

*Primary Examiner* — Calvin C Ma
(74) *Attorney, Agent, or Firm* — Typha IP LLC

(57) ABSTRACT

A display device in an embodiment according to the present invention includes a pixel region includes a plurality of pixels arranged in a matrix, a first power source line arranged in the pixel region and provided with a first power source voltage supplying a current to the plurality of pixels, a second power source line located in a layer higher than the first power source line in the pixel region and including an intersection part intersecting the first power source line and provided with a second power source voltage different to the first power source voltage, a conducting layer interposed between the first power source line and the second power source line via an insulation layer and having at least one part overlapping the intersection part, a current detection portion electrically connected with the conducting layer.

14 Claims, 12 Drawing Sheets

DISPLAY DEVICE

CROSS REFERENCE TO RELATED APPLICATIONS

This application is based upon and claims the benefit of priority from the prior Japanese Patent Application No. 2015-179304 filed on Sep. 11, 2015, the entire contents of which are incorporated herein by reference.

FIELD

The present invention is related to a display device. One embodiment of the invention disclosed in the present specification is related to a wiring structure of a display device.

BACKGROUND

A display device is formed with a display screen by a pixel region arranged with a plurality of pixels. A scanning signal line is arranged in row direction and a video signal line is arranged in a column direction in the pixel region. An intersection part where the scanning signal line and video signal line intersect via an insulation layer is included in the pixel region. Since a different signal is supplied to the scanning signal line and video signal line respectively, display defects become apparent when a pixel short circuits. As a result, a display device arranged with apparatus for preventing short circuit defects in an intersection part of a wire has been disclosed (see Japanese Laid Open Patent No. H11-119240).

A display device arranged with a light emitting element using an organic electroluminescence material arranged in each pixel is arranged with an anode electrode in each pixel and a cathode pixel which is arranged opposing the anode electrode sandwiching an organic layer is arranged as a common electrode spreading across roughly the entire surface of a pixel region. When a cathode electrode is formed using a transparent conductive layer, a drop in voltage due to a loss in resistance becomes a problem. A structure in which auxiliary wiring is arranged in order to prevent a drop in voltage of a cathode electrode has been disclosed (for example, see Japanese Laid Open Patent No. 2015-072761).

SUMMARY

A display device in an embodiment according to the present invention includes a pixel region includes a plurality of pixels arranged in a matrix, a first power source line arranged in the pixel region and provided with a first power source voltage supplying a current to the plurality of pixels, a second power source line located in a layer higher than the first power source line in the pixel region and including an intersection part intersecting the first power source line and provided with a second power source voltage different to the first power source voltage, a conducting layer interposed between the first power source line and the second power source line via an insulation layer and having at least one part overlapping the intersection part, a current detection portion electrically connected with the conducting layer, and a switch portion to cut off the connection between the first power source line and a first power source or a connection between the second power source line and a second power source when a current above a certain value is detected in the current detection portion.

A display device in an embodiment according to the present invention includes a pixel region includes a plurality of pixels arranged in a matrix, a first power source line arranged in the pixel region and provided with a first power source voltage supplying a current to the plurality of pixels, a second power source line located in a layer higher than the first power source line in the pixel region and including an intersection part intersecting the first power source line via a first insulation layer and provided with a second power source voltage different to the first power source voltage, a pixel electrode arranged in a pixel and electrically connected to the first power source line via a transistor and having a region overlapping the second power source line via a second insulation layer, a current detection portion electrically connected with the second power source line, and a switch portion to cut off the connection between the first power source line and a first power source when a current above a certain value is detected in the current detection portion.

DESCRIPTION OF EMBODIMENTS

Embodiments of the present invention will hereinafter be described with reference to the drawings. The present invention can be implemented according to many different embodiments, and is not intended to be interpreted by being limited to description contents of the embodiments illustrated below. While the width, the thickness, the shape, and the like of each of portions may be more schematically represented than those in an actual form to make the description clearer, this is only one example, and is not intended to limit the interpretation of the present invention. In the present specification and the drawings appended thereto, similar elements to those described above with reference to the already illustrated drawing may be assigned the same reference signs or similar reference signs (reference signs having a, b, etc. added after numbers) to omit detailed description, as needed. Further, characters having "first", "second", etc. added to elements are used for reference only to distinguish the elements, and do not means more than that unless otherwise particularly described.

In the present specification, when a member or region exists "on (or under)" another member or region, this includes not only a case where the member or region exists just above (or just below) the other member or region but also a case where the member or region exists above (or below) the other member or region, i.e., includes a case where another constituent element is included between the member or region above (below) the other member or region and the other member or region.

Furthermore, unless otherwise noted in the explanation below, the side where a second substrate is arranged with respect to a first substrate is referred to as "above" or "upper" and the reverse is referred to as "below" or "lower".

A scanning signal line and a video signal line are arranged in a pixel region of a display device. In the case where a light emitting element is arranged in a pixel, a power source line is also necessary for supplying light emitting power. Furthermore, when auxiliary wiring of a cathode electrode is arranged, the number of wires which intersect other wiring via an insulation layer increases significantly.

Even if an insulation layer is arranged on a surface of wiring in order to prevent short circuits between intersecting wires, display defects occur when short circuits occur due to the mixture of foreign objects during manufacture or due to other external causes. In particular, when a power source line short circuits with other wiring, a short circuit current flows and generates heat which may further lead to smoke being emitted.

One embodiment of the present invention discloses a display device which appropriately detects a short circuit between wiring. In addition, one embodiment of the present invention discloses a display device which can terminate operation when a short circuit between wiring is detected.

1. Outline of Display Device

Figure 1:
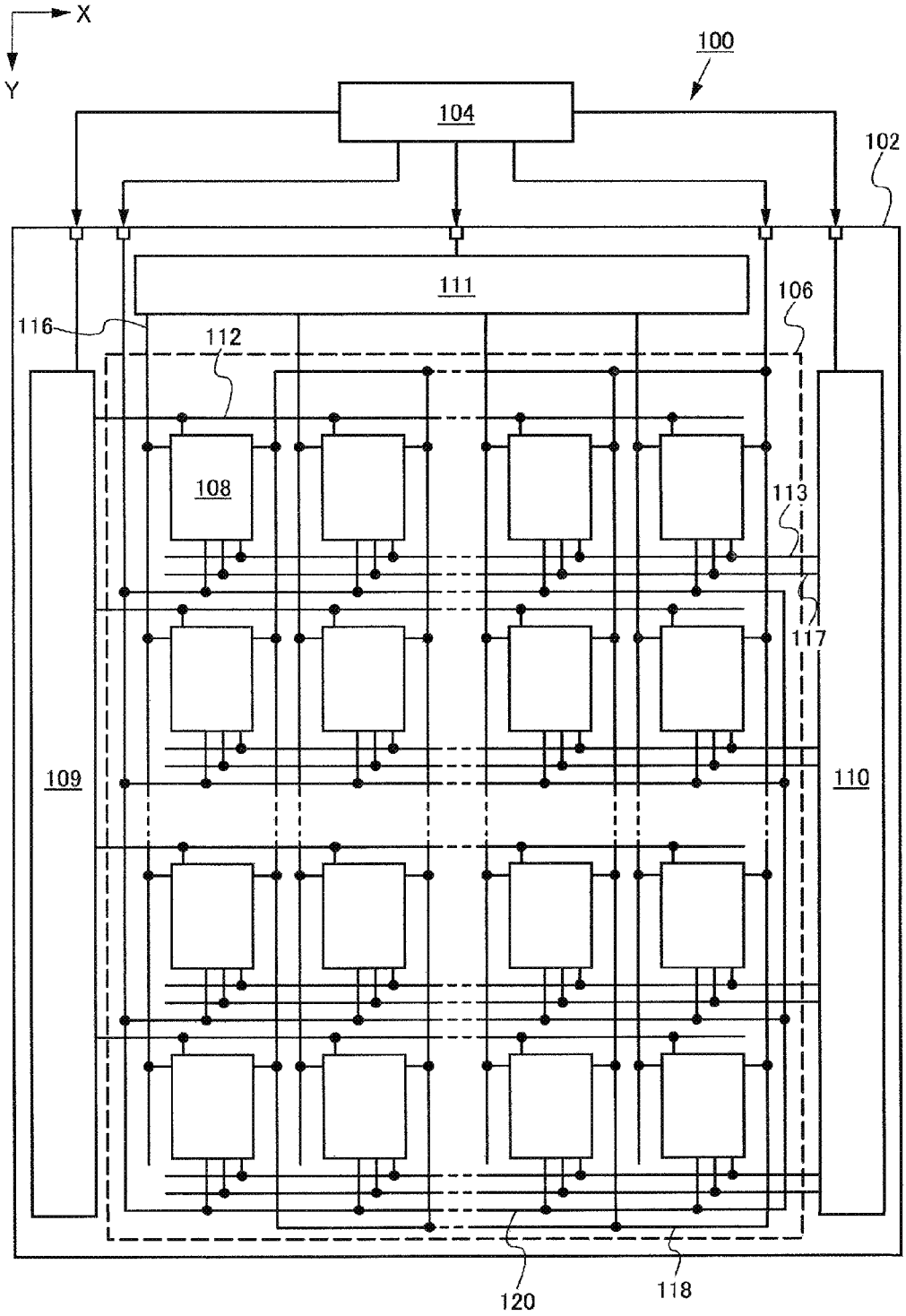
FIG. 1 is a diagram showing a structure of a display device related to one embodiment of the present invention.

FIG. 1 shows a structure of a display device 100 related to one embodiment of the present invention. The display device 100 includes a display panel 102 arranged with a pixel region 106 which forms a display screen. In addition, the display device 100 includes a controller 104 which outputs a control signal to the display panel 102.

The pixel region 106 is arranged with a plurality of pixels 108 in a row direction and a column direction (as a matrix). For example, assuming m number of pixels 108 are arranged in a row direction (X direction) and n number of pixels 108 are arranged in a column direction (Y direction), the number of pixels in the pixel region 106 becomes m×n pixels. Furthermore, although FIG. 1 shows an example of a square arrangement of the pixels 108, the display device 100 related to the present embodiment is not limited to this arrangement and a delta arrangement or other arrangement shape may also be applied.

The display panel 102 is arranged with a drive circuit which is supplied with a signal from the controller 104. The drive circuit includes a first drive circuit 109 for driving a first scanning signal line 112, a second drive circuit 110 for driving a second scanning signal line 113, and a third drive circuit 111 for driving a video signal line 116. In addition, the display panel 102 is arranged with a first power source line 118 which supplies a first power source voltage (PVH) to a light emitting element of the pixel 108, and a second power source line 120 which supplies a second power source voltage (PVL). The first scanning signal line 112, the second scanning signal line 113 and the video signal line 116 are arranged including a part which intersects sandwiching an insulation layer. Similarly, the first power source line 118 and the second power source line 120 are arranged including a part which intersects sandwiching an insulation layer. A light emitting element which is formed using an electroluminescence material is arranged in the pixel 108.

2. Equivalent Circuit of a Pixel

Figure 2:
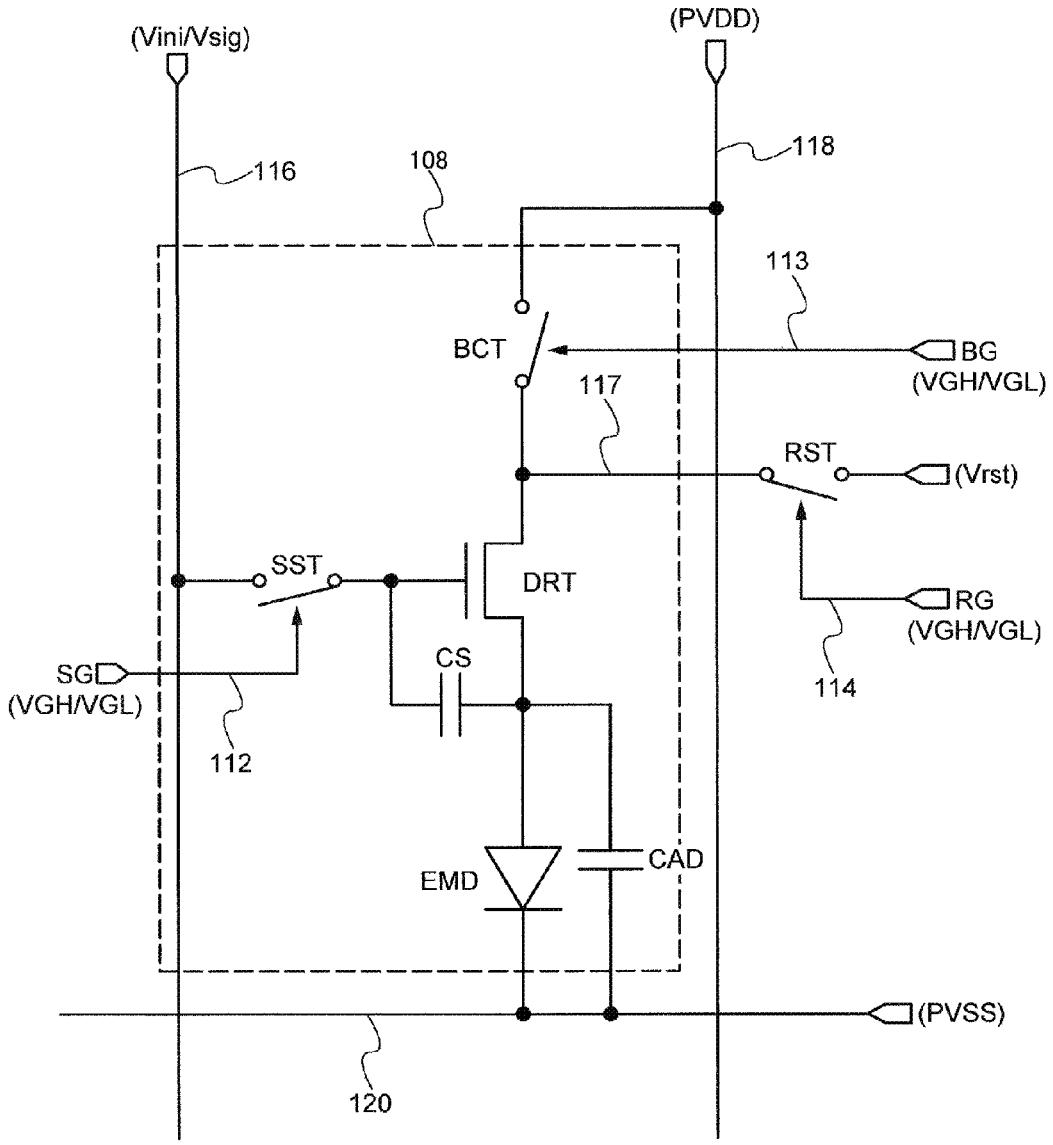
FIG. 2 is a diagram showing an example of an equivalent circuit of a pixel circuit of a display device related to one embodiment of the present invention.

FIG. 2 shows an equivalent circuit of a pixel 108. A pixel 108 is formed including a drive transistor DRT and a light emitting element EMD. The light emitting element EMD is arranged between the first power source line 118 and the second power source line 120. A different voltage is supplied to the first power source line 118 and the second power source line 120. For example, a first power source voltage (PVH) is supplied to the first power source line 118 and a second power source voltage (PVL) which is lower than the first power source voltage (PVH) is supplied to the second power source line 120.

The light emitting element EMD is a two terminal element and includes rectification properties the same as a diode. The light emitting element EMD is supplied with a voltage above a light emitting threshold voltage and emits light when a forward current flows. The light emitting intensity of the light emitting element EMD changes in proportion to an increase or decrease in an amount of current within a range of actual operation.

The drive transistor DRT is an insulation gate type field effect transistor including a gate as a control terminal and a source and drain as input/output terminals. The drive transistor DRT is arranged between the first power source line 118 and the light emitting element EMD. Specifically, one of the input/output terminals corresponding to the source and drain of the drive transistor DRT is electrically connected with the first power source line 118 via a second switch BCT. In addition, the other input/output terminal corresponding to the source and drain of the drive transistor DRT is electrically connected with one of the terminals of the light emitting element EMD.

A first switch SST is arranged between the video signal line 116 and the gate of the drive transistor DRT. The gate of the drive transistor DRT is electrically connected with the video signal line 116 via the first switch SST. The first switch SST controls an ON/OFF operation using a control signal SG (including an amplitude VGH/VGL) supplied to the first scanning signal line 112. When the control signal takes one of the voltages VGH, VGL the switch SST is switched ON and switched OFF when the other voltage is taken. When the first switch SST in ON a voltage of the video signal line 116 is supplied to the gate of the drive transistor DRT.

The drive transistor DRT is connected in series with the light emitting element EMD via a second switch BCT between the first power source line 118 and the second power source line 120. The second switch BCT is controlled by a scanning signal of the second scanning signal line 113. When the second switch BCT is ON, the drive transistor DRT is electrically connected with the first power source line 118.

In the present embodiment, the drive transistor DRT is an n-channel type. In the explanation below, for the sake of convenience the input/output terminal on the side electrically connected with the first power source line 118 in the drive transistor DRT is the drain and the input/output terminal on the side electrically connected with the light emitting element EMD is the source.

A capacitor element CS is arranged between the source and gate of the drive transistor DRT. The capacitor element CS holds a voltage between the gate and source of the drive transistor DRT. A drain current of the drive transistor DRT is controlled by a gate voltage. The light emitting intensity of the light emitting element EMD is controlled by the drain current of the drive transistor DRT. In addition, an auxiliary capacitor element is arranged between the drain of the drive transistor DRT and the second power source line 120. The auxiliary capacitor element CAD is charged by a drain current of the drive transistor DRT and adjusts the amount of light emitting current of the light emitting element EMD. A voltage is supplied to the gate of the drive transistor DRT based on a video signal and when the second switch BCT is ON, a drain current flows into the light emitting element EMD and light is emitted.

An initialization signal Vini and a video signal Vsig are supplied alternately to the video signal line 116. The initialization signal Vini is a signal which supplies an initialization voltage of a fixed level to the gate of the drive transistor DRT. In addition, the video signal Vsig is a voltage signal based on a video signal. An ON/OFF state of the first switch SST is controlled at a certain timing in synchronization with the initialization signal Vini and video signal Vsig supplied to the video signal line 116. When a signal is supplied to the video signal line 116, the initialization signal Vini or video signal Vsig is supplied to the gate of the drive transistor DRT by the operation of the first switch SST.

The drain of the drive transistor DRT is electrically connected with a reset signal line 117. A reset voltage Vrst is supplied to the reset signal line 117. A third switch RST controls the timing when a reset voltage is supplied to the reset signal line 117. ON/OFF control of the third switch RST is performed by a scanning signal RG (including an amplitude VGH/VGL) of a reset control signal line 114.

A switching element is used in the first switch SST, second switch BCT and third switch RST. As an example of a switching element, it is possible to apply a transistor having the same structure as a drive transistor. For example, the first switch SST, second switch BCT and third switch RST can be realized using an n-channel type transistor.

Furthermore, the equivalent circuit of a pixel shown in FIG. 2 is one example and the display device 100 of the present invention is not to be applied limited to this pixel circuit. As long as a pixel circuit arranged with the first power source line 118 and the second power source line 120 having different voltages are included in at least a pixel circuit arranged with a light emitting element EMD, it is possible to be similarly applied even when other circuit structures are included.

3. Structure of Pixel Region (1)

Figure 3:
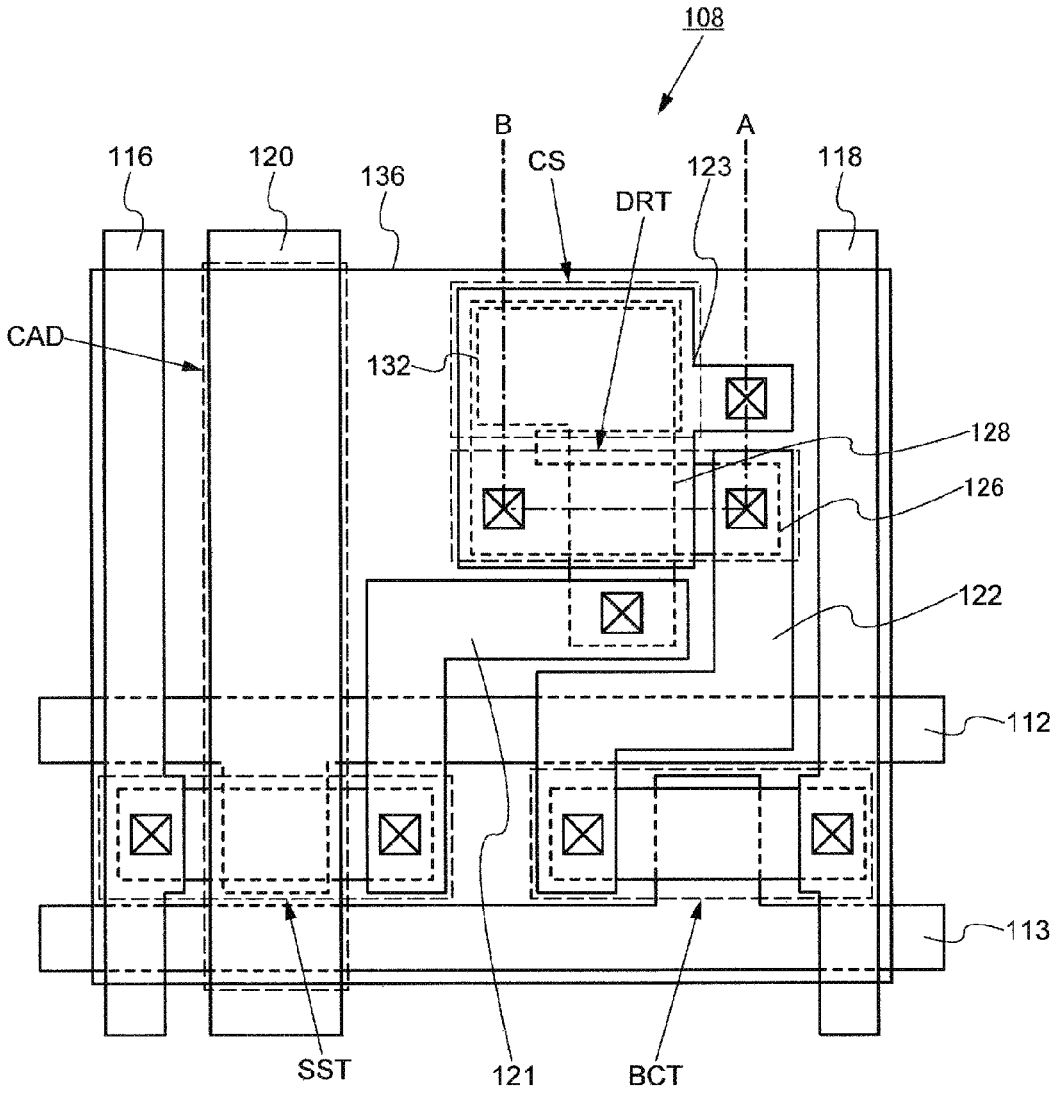
FIG. 3 is a planar view diagram showing a pixel layout of a display device related to one embodiment of the present invention.

An example of a pixel corresponding to the pixel circuit shown in FIG. 2 is shown in FIG. 3. FIG. 3 shows a planar layout of the pixel 108 and a cross-sectional structure along the line A-B is shown as the region A in FIG. 4. The structure of a pixel is explained below while referring to FIG. 3 and FIG. 4.

The display device 100 includes a first substrate 124 and a second substrate 125 arranged opposing the first substrate 124. The drive transistor DRT, light emitting element EMD, capacitor element CS, and auxiliary capacitor element CAD and the like are arranged in the region A of the first substrate 124. The second substrate 125 has the function of a sealing material and is arranged above the light emitting element EMD. Furthermore, although the second substrate 125 mainly protects the light emitting element EMD from vapor water and also includes a function for preventing foreign objects from contacting a surface, for example, the second substrate 125 may also be omitted by forming an insulation layer as a protection layer in an upper layer of the light emitting element EMD.

The drive transistor DRT is formed including a semiconductor layer 126, a gate insulation layer 127 and a gate electrode 128. A drain region of the drive transistor DRT is electrically connected with the second switch BCT via a drain line 122 and a source region is electrically connected with a source line 123. The source line 123 is arranged so as to overlap the gate electrode 128 via an interlayer insulation layer and is electrically connected with a pixel electrode 144 of the light emitting element EMD. A capacitor element CS is formed by a region where the source line 123 and a first capacitor electrode 132 overlap. The first capacitor electrode 132 and the gate electrode 128 are formed in the same layer. The gate electrode 128 of the drive transistor DRT is electrically connected with the first switch SST via the gate line 121. Furthermore, the first switch SST and second switch BCT are formed by a similar transistor as the drive transistor DRT.

A gate electrode of the transistor which forms the first switch SST is electrically connected with the first scanning signal line 112 and either a source or drain is electrically connected with the video signal line 116. A transistor which forms the second switch BCT is arranged with a gate electrode so as to electrically connect with the second scanning signal line 113 and either a source or drain is electrically connected with the first power source line 118.

Figure 4:
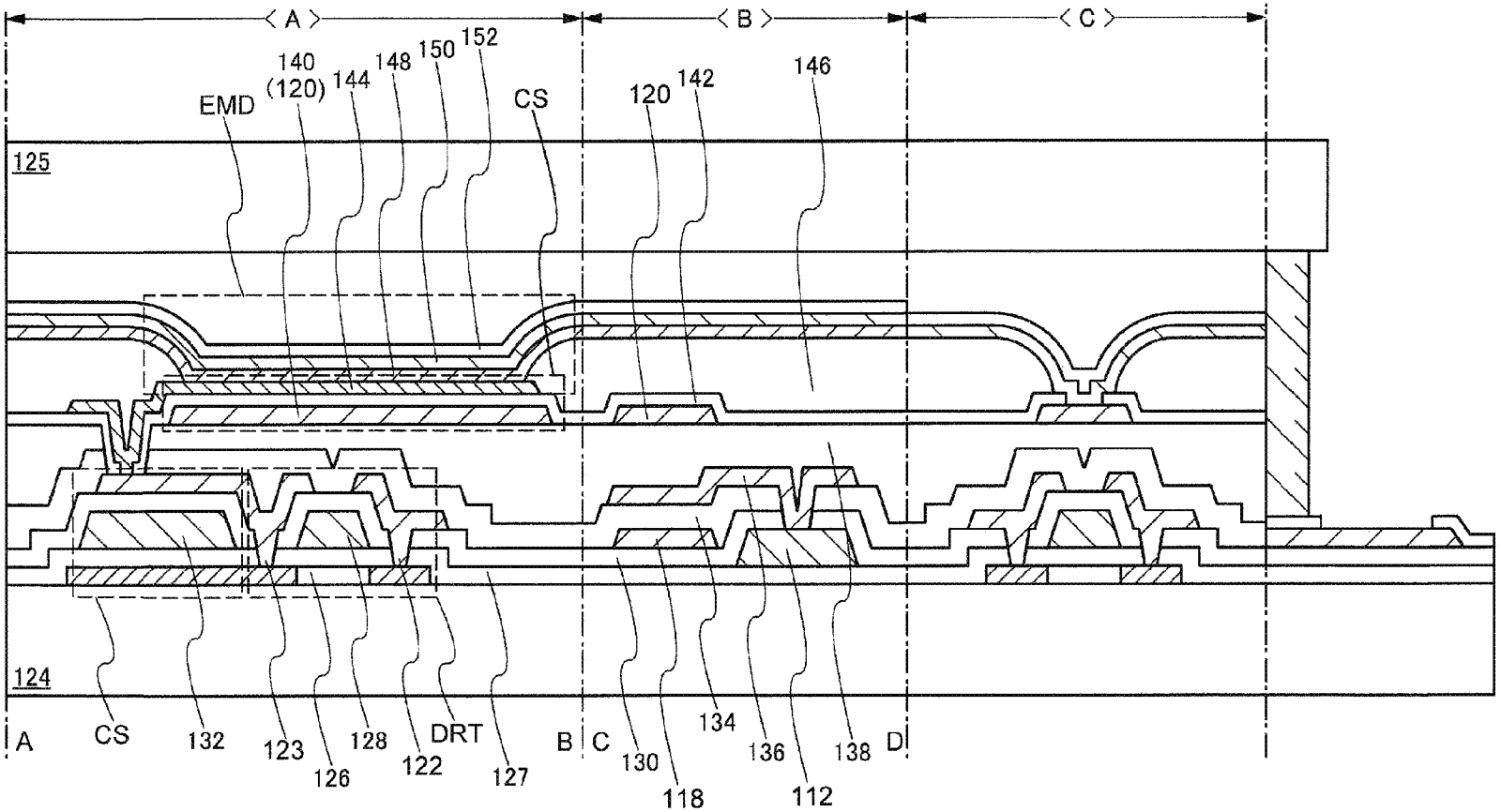
FIG. 4 is a cross-sectional diagram showing a structure of a display device related to one embodiment of the present invention.

In the cross-sectional structure shown in FIG. 4, a first insulation layer 130 is arranged between the gate electrode 128, source line 123 and drain line 122. A second insulation layer 134 and third insulation layer 138 are arranged between the source line 123, drain line 122 and pixel electrode 144.

The light emitting element EMD includes a structure in which a pixel electrode 144, organic layer 148 and opposing electrode 150 are stacked. A sealing layer 152 is arranged on an upper surface of the light emitting element EMD. The auxiliary capacitor element CAD includes a structure in which a pixel electrode 144, fourth insulation layer 142 and second capacitor electrode 140 are stacked. The second electrode 140 which forms the auxiliary capacitor element CAD is on the same layer as the second power source line 120, and functions as the second capacitor electrode 140 in a region overlapping the pixel electrode 144 via the fourth insulation layer 142.

Figure 5:
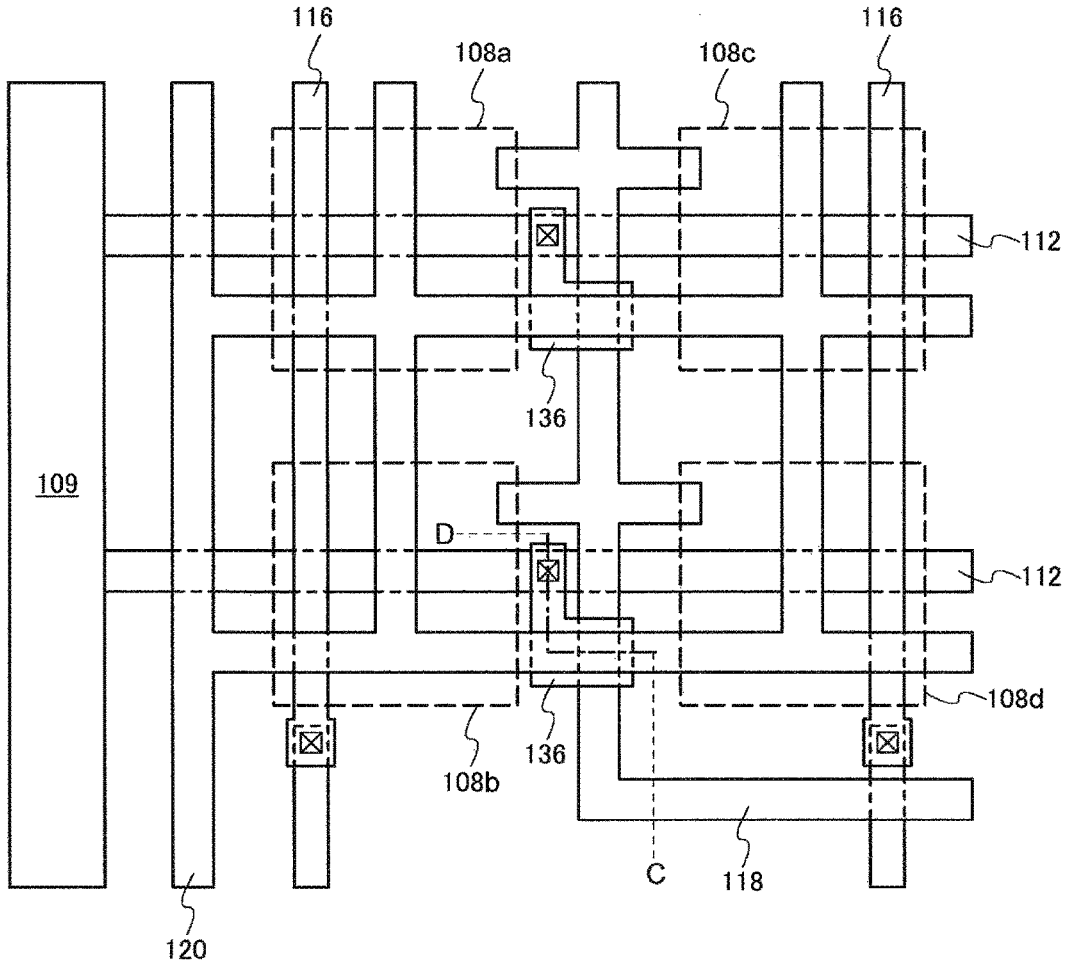
FIG. 5 is a planar view diagram for explaining a structure of wiring arranged in a pixel region of a display device related to one embodiment of the present invention.

FIG. 5 shows a structure of wiring in the pixel region 106. FIG. 5 shows the arrangement of a first scanning signal line 112, video signal line 116, first power source line 118 and second power source line 120 and the details of other wiring and the pixel electrode 108 are omitted. In the pixel region 106, the scanning signal line 112 is arranged in a row direction and the video signal line 116 is arranged in a column direction. The first power source line 118 and video signal line 116 are arranged roughly in parallel and wiring is arranged in a row and column direction so that the second power source line 120 is linked between each pixel 108. The first power source line 118 and second power source line 120 are arranged via an insulation layer. By arranging the second power source line 120 in a row direction and a column direction, an intersection part is provided which intersects with the first power source line 118.

A conducting layer 136 is arranged at the intersection part between the first power source line 118 and second power source line 120. Details of this intersection part are shown by the region B in FIG. 4 as a cross-sectional structure corresponding to the line C-D in FIG. 5. The region B is a wiring region provided between pixels.

The conducting layer 136 is electrically connected with the first scanning signal line 112. The conducting layer 136 is arranged so that at least one part overlaps with the first power source line 118 sandwiching the second insulation layer 134. In addition, the conducting layer 136 is arranged so that at least one part overlaps with the second power source line 120 sandwiching the third insulation layer 138. That is, the conducting layer 136 includes a region which overlaps the first power source line 118 and second power source line 120 via an insulation layer. Furthermore, as is shown in FIG. 4, the first power source line 118 is arranged in a layer lower than the second power source line 120. Since the second power source line 120 is covered by a bank layer 146 arranged between pixels and the fourth insulation layer 142, a structure is provided in which the organic layer 148 of the light emitting element EMD and the opposing electrode 150 do not directly contact.

The second insulation layer 134 which insulates the first power source line 118 and conducting layer 136 is formed from an inorganic insulation material such as silicon oxide or silicon nitride. On the other hand, since the third insulation layer 138 insulates the first power source line 118 and second power source line 120 and is also arranged with the function of a planarized film, an organic insulation material such as polyimide or acrylic is used. Even if the first power source line 118 and second power source line 120 are arranged to intersect, they are generally formed using the second insulation layer 134 and third insulation layer 138. However, when foreign objects become mixed during the manufacturing process or other external causes are in operation, there is concern that short circuit defects may occur at the intersection part of the first power source line 118 and second power source line 120. Since the first power source line 118 and second power source line 120 are supplied with different voltages, if short circuits occur, heat due to an excess current or defects such as smoke occur.

The conducting layer 136 is used to detect abnormalities when short circuit defects occur at the intersection part between the first power source line 118 and second power source line 120. Since the conducting layer 136 is sandwiched by the second insulation layer 134 and third insulation layer 138, usually the first power source line 118 and second power source line 120 are insulated. However, when the contamination of foreign material and other external factors in the manufacturing process is acted, the conducting layer 136 short circuits with one or both of the first power source line 118 and second power source line 120. In the case where such defects occur, it is possible to detect such defects by detecting a current which flows to the conducting layer 136.

Furthermore, the region C shown in FIG. 4 shows a region where the opposing electrode 150 is connected with the second power source line 120 or a wire with the same voltage as the second power source line 120. The region C is arranged in the external side region of the pixel region 106.

FIG. 5 shows a structure whereby the conducting layer 136 is connected with the first scanning signal line 112. When a leak current flows from one or both of the first power source line 118 and second power source line 120 to the conducting layer 136, the leak current flows into the first scanning signal line 112. A first drive circuit 109 monitors a power source voltage or current value of the first scanning signal line 112 and thereby it is possible to detect abnormalities. Specifically, since a consumption current value increases more than normal in the case where a leak current is generated with respect to normal current consumption being generated by driving the first scanning signal line 112, it is sufficient that this is detected. Since the first drive circuit 109 only outputs a signal for controlling ON/OFF of the first switch SST to the scanning signal line 112, it is difficult for the circuit to be affected by a video signal which is supplied to the video signal line 116 or the characteristics of the light emitting element EMD, and it is possible to easily detect abnormalities occurring from a variation in a power source voltage or current.

Figure 6:
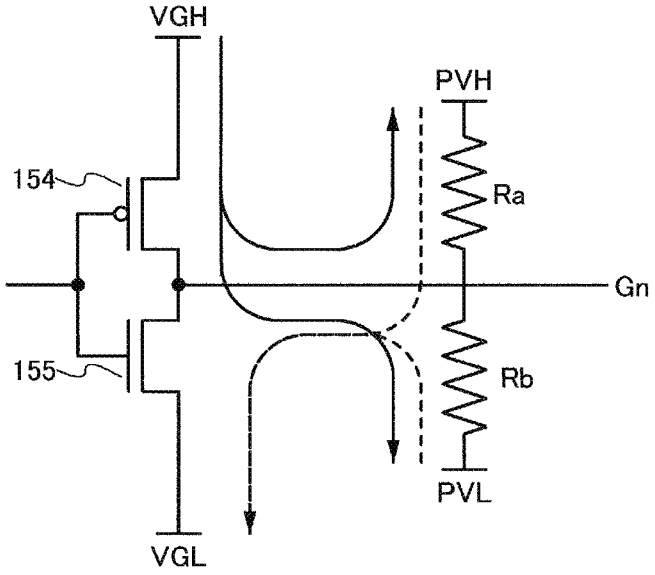
FIG. 6 is a diagram for explaining the operation of a gate buffer circuit of a display device related to one embodiment of the present invention.

FIG. 6 shows a gate buffer circuit as an example of a circuit included in the first scanning signal line 109. A gate buffer circuit here indicates a part which amplifies an output of the first drive circuit 109 so that there is sufficient current capability to drive the first scanning signal line 112. The first scanning signal line 112 is connected to the gate buffer circuit. The gate buffer circuit is connected with a positive power source and a negative power source and outputs a scanning signal Gn, Gn+1 . . . to the first scanning signal line 112. In the case where the conducting layer 136 is connected to the first scanning signal line 112, the conducting layer 136 is essentially connected with either one of a positive power source or negative power source. In the case where the conducting layer 136 is connected to the first scanning signal line 112, if insulation between the first power source line 118 and conducting layer 136 is maintained, resistance Ra ideally becomes limitless (although a limited resistance value can be maintained, resistance Ra has a large value to the extent that it is possible to ignore a leak current with respect to circuit operation). Resistance Rb between the second power source line 120 and conducting layer 136 is the same.

In the case where the conducting layer 136 and the first power source line 118 are conducting due to insulation defects, resistance Ra decreases. Resistance Rb also decreases in the case where the conducting layer 136 and the second power source line 120 are conducting due to insulation defects. In this case, it is preferred that a certain voltage relationship is provided so that a single direction current flows from a power source for driving the first scanning signal line to the first power source line 118 and second power source line 120 via resistors Ra, Rb. That is, a positive power source voltage (VGH) is preferred to be higher than a first power source voltage (PVH) and second power source voltage (PVL) and a negative power source voltage (VGL) is preferred to be lower than a first power source voltage (PVH) and second power source voltage (PVL).

For example, in the gate buffer circuit shown in FIG. 6, a voltage VGL of a lower voltage power source is preferred to be lower than the voltage of the second power source line 120. In this case, as is shown by the dotted line in FIG. 6, when a p-channel transistor 154 is OFF and an n-channel transistor 155 is ON, a current flow from the first power source line 118 and second power source line 120 to a low voltage power source. In this case, as is shown by the solid line in FIG. 6, when a p-channel transistor 154 is ON and an n-channel transistor 155 is OFF, a current flow from a high voltage power source to the first power source line 118 and second power source line 120.

More specifically, the conditions described above are satisfied in the case where a voltage VGH of a high voltage power source connected to a gate buffer circuit is 12.5V, a voltage VGL of a lower voltage power source is −3.5V, a voltage of a first power source line 118 is 10V and a voltage of a second power source line 120 is −3.0V. Furthermore, the voltages described are an example and a current voltage supplied to a gate buffer circuit with respect to the first power source line 118 and second power source line 120 which supply an output to a light emitting element EMD can be higher than a voltage of the first power source line 118 on the high voltage side and lower than a voltage of the second power source line 120 on the low voltage side.

In the case where the conducting layer 136 is connected with the first scanning signal line 112, it is desirable that a time period in which a scanning signal Gn, Gn+1 supplied to the first scanning signal line 112 is selected is short, that is, it is desirable that a time period in which a voltage VGL is supplied to the first scanning signal line 112 is long in order to more accurately detect an abnormal current.

The display device 100 is preferred not to continue operating in a state where an abnormal current is flowing to the conducting layer 136. Therefore, it is preferred that the display device 100 is arranged with a function for terminating an operation of the display panel 102 at the point where an abnormal current is detected.

Figure 7:
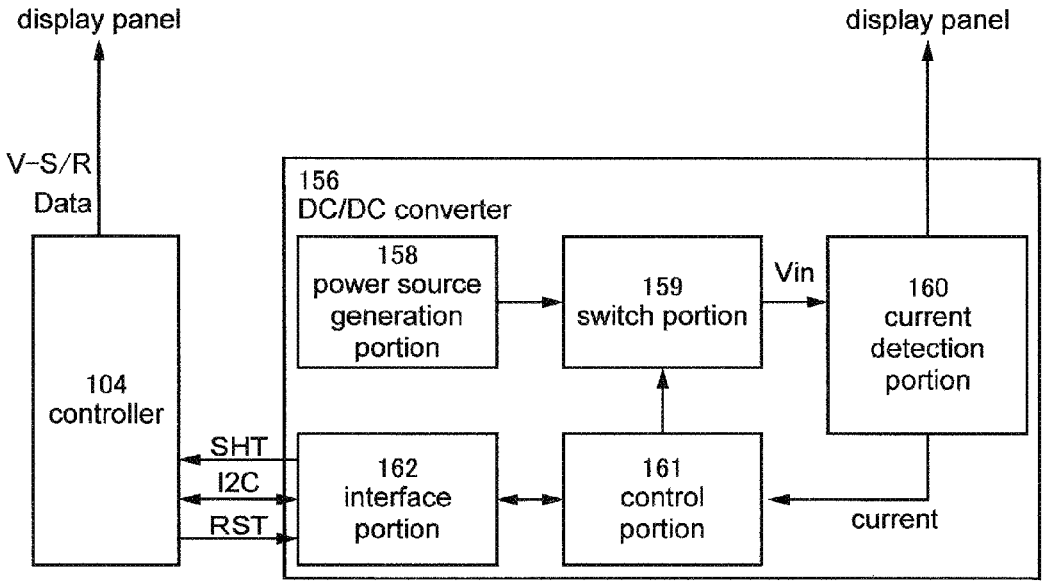
FIG. 7 is a block diagram showing an example of a circuit structure of a power source portion of a display device related to one embodiment of the present invention.

FIG. 7 shows an example of a circuit structure for terminating an operation of a display panel 102 using a block diagram. A DC/DC converter includes a power source generation portion (module) 158, switch portion (module) 159, current detection portion (module) 160, control portion (module) 161 and interface portion (module) 162.

The power source generation portion 158 generates and outputs a power source voltage required for operating the display panel 102. The current detection portion 160 detects a value of a current flowing to a power source line, converts to A/D and outputs to a control portion. The control portion 161 determines the presence of an abnormal current. For example, the level of a threshold value current for determining an abnormal current is stored in advance in a register, a current detection signal output from the current detection portion 160 and the threshold value current level are compared and the presence of abnormalities is determined. When the control portion detects an abnormal current, a power source blocking signal is output to the switch 159. When a power source blocking signal is input from the control portion 161, the switch portion 159 blocks a connection between the power source generation portion 158 and the current detection portion 160 and blocks the supply of power to the panel. In addition, the interface portion 162 sends and receives signals between the control portion 161 and controller 104.

Furthermore, in the case where a threshold value current level is different depending on a tone to be displayed, a video signal of each frame may be incorporated, a predicted current value is estimated from the obtained tone data, and the estimated value is stored in a register of the control portion 161 as a threshold value current level. In addition, when a current flow between the first power source line 118 and second power source line 120 due to insulation defects, it is preferred that the set threshold value current level is set in advance to a current level whereby structural components (for example, substrate material) are not damaged due to heat. Furthermore, the threshold value current level to be set may be a weak current value so that significant problems do not occur in terms of pixel circuit operation. With respect to insulation defects which deteriorate over time, by detecting abnormalities using a weak current tone, it is possible to detect the occurrence of defects in advance and improve reliability of the display device 100. Using this structure, it is possible for the present invention to accurately detect an abnormal current. In other words, when an amount of current flowing from the power source generation portion 158 increases due to a tone of a video signal, it is possible to prevent incorrect operation whereby an abnormal current is determined by mistake and the operation of the display panel 102 is terminated.

Figure 8:
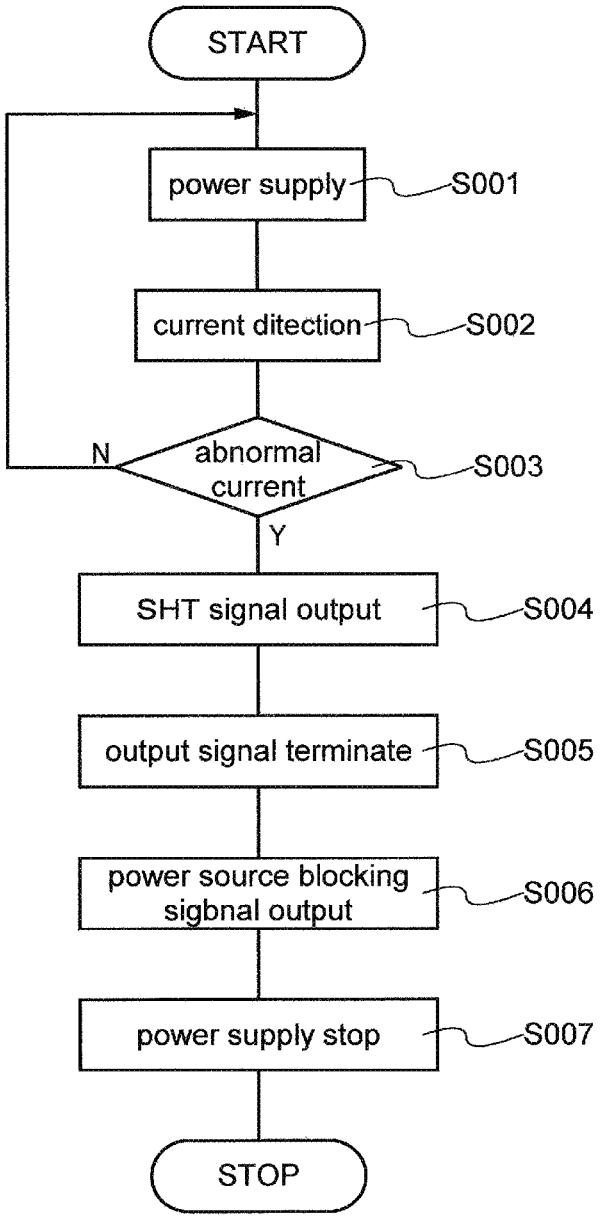
FIG. 8 is a diagram showing a flowchart for explaining the operation of a display device related to one embodiment of the present invention.

FIG. 8 shows a flowchart for explaining an operation of the DC/DC converter 156. The power source generation portion 158 supplies power to a panel (S001). The current detection portion 160 reads an amount of current flowing to a power source line and outputs to the control portion 161 (S002). The control portion 161 receives the current value read by the current detection portion 160 and determines the presence of abnormalities (S003). An abnormality determination may be made when a current signal exceeds a certain threshold value level as described above. As a result of the determination, the control portion 161 instructs the power source generation portion 158 to continue supplying power when an abnormal current is not detected (in the case of an N determination in S003).

On the other hand, when an abnormal current is detected, the control portion 161 outputs a signal for terminating the operation of the display device (in the case of a Y determination in S003). When an abnormal current is detected, the control portion 161 outputs a shutdown signal (SHT signal) to the controller 104 via the interface portion 161 (S004). When the controller 104 receives the SHT signal, an output signal is terminated (S005). Specifically, a shift register control signal which is output to the first drive circuit 109 (and second drive circuit 110) and a video signal which is output to the third drive circuit 111 are terminated. In addition, the controller 104 outputs a control signal for blocking a connection between the power source generation portion 158 and display panel 102 to the interface portion 162 generally using a control signal (12C signal) or reset signal (RST signal) (S004). The control portion 161 outputs a power source blocking signal to the switch portion 159 (S006). When the switch portion 159 operates and connection between the power source generation portion 158 and display panel 102 is blocked, the supply of power to the display panel 102 is blocked (S007).

The operation of the display panel 102 is terminated by the series of operations shown in FIG. 8. That is, in the display device 100, when a leak current flows to the first scanning signal line 112 from the first power source line 118 and/or the second power source line 120 via the conducting layer 136 in the structure shown in FIG. 5, an abnormal current is detected by the DC/DC converter 156 shown in FIG. 7 and a power supply to the display panel 102 is terminated. Furthermore, the operation for blocking a connection between the power source generation portion 158 and the display panel 102 may be an operation for blocking a connection between a power source portion and the first power source line 118 and/or power source line 120 by the switch portion 159.

Furthermore, although a structure is shown in the present embodiment whereby the first scanning signal line 112 and conducting layer 136 are connected and a short circuit current is detected, the present invention is not limited to this structure. For example, it is possible to similarly detect a short circuit current even when the conducting layer is connected to the second scanning signal line 113.

According to one embodiment of the present invention it is possible to easily detect a short circuit current flowing between wires. In addition, it is possible to accurately terminate the operation of a display device by control so that a signal which is output to a display panel is terminated when a short circuit is detected between wires.

Furthermore, although the present embodiment exemplifies a form whereby a conducting layer is arranged at an intersection part between the first power source line 118 and second power source line 120, the present invention is not limited to this form. For example, even in the case where the first power source line 118 and second power source line 120 are arranged in parallel sandwiching an insulation layer, if sections are present where short circuits between wires easily occur due to insulation defects, it is possible to detect an abnormal current by similarly arranging a conducting layer.

4. Structure of Pixel Region (2)

Figure 9:
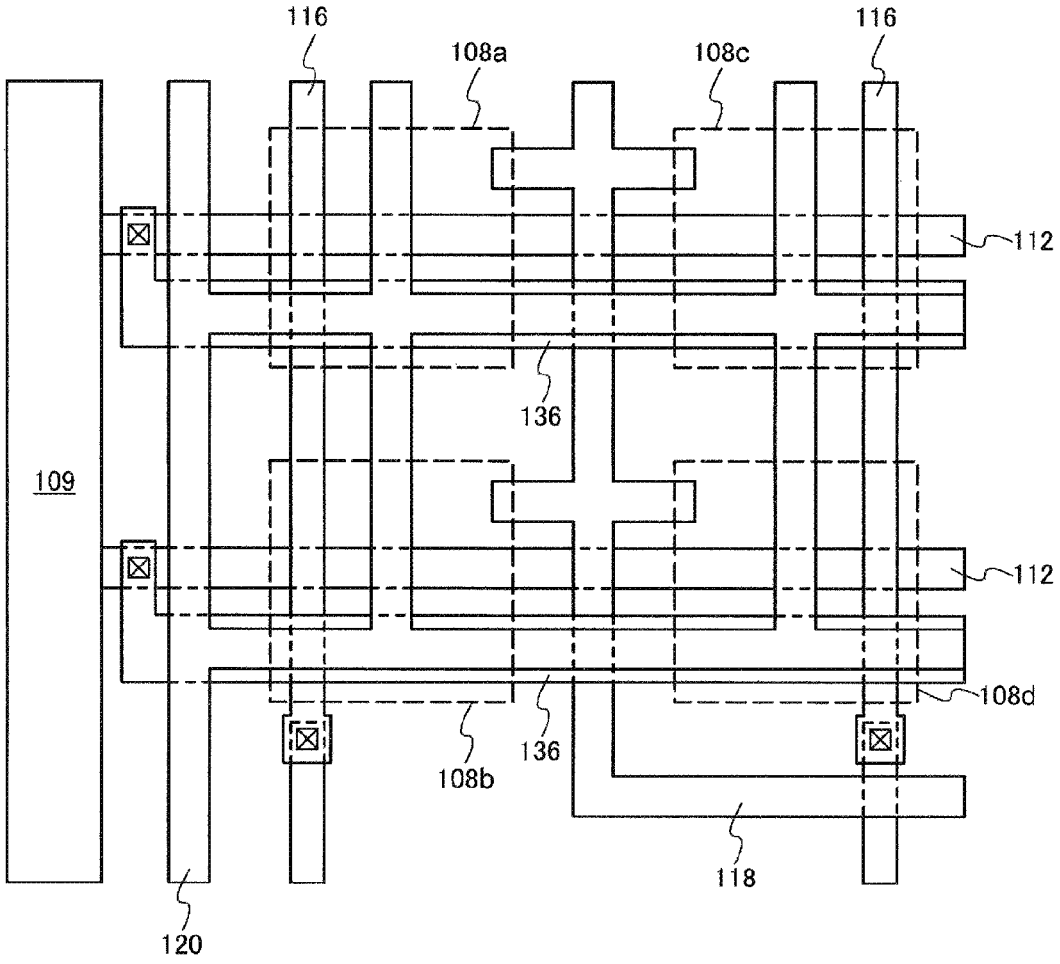
FIG. 9 is a planar view diagram for explaining a structure of wiring arranged in a pixel region of a display device related to one embodiment of the present invention.

FIG. 9 shows a form wherein the conducting layer 136 arranged at the intersection part between the first power source line 118 and second power source line 120 is different to that in FIG. 5. Although an intersection part between the first power source line 118 and second power source line 120 exists at a plurality of sections in the pixel region 106, the intersection parts may also be linked between pixels adjacent to the conducting layer 136. FIG. 9 shows a form wherein the conducting layer 136 which is connected to the same first scanning signal line 112 is arranged along the second power source line 120. By arranging the conducting layer 136 along the second power source line 120 in this way, it is possible to detect insulation defects in an intersection part not only with the first power source line 118 but also with the video signal line 116. In addition, by linking the conducting layer 136 between adjacent pixels, it is possible to reduce the number of contacts which are connected to the first scanning signal line 112. By reducing the number of contacts, it is possible to reduce the proportion of contact defects that occur between the conducting layer 136 and the first scanning signal line 112.

In addition, a contact between the conducting layer 136 and the first scanning signal line 112 may also be arranged at one end of a pixel region 106. In this way, it is no longer necessary to arrange a contact between the conducting layer 136 and the first scanning signal line 112 between pixels and a pixel pitch may be narrowed which is effective for achieving high definition. Furthermore, the operational principles in the structure of the pixel region 106 shown in FIG. 9 are the same as in the structure of the pixel region 106 shown in FIG. 5 and it is possible to obtain the same operational effects.

5. Structure of Pixel Region (3)

Figure 10:
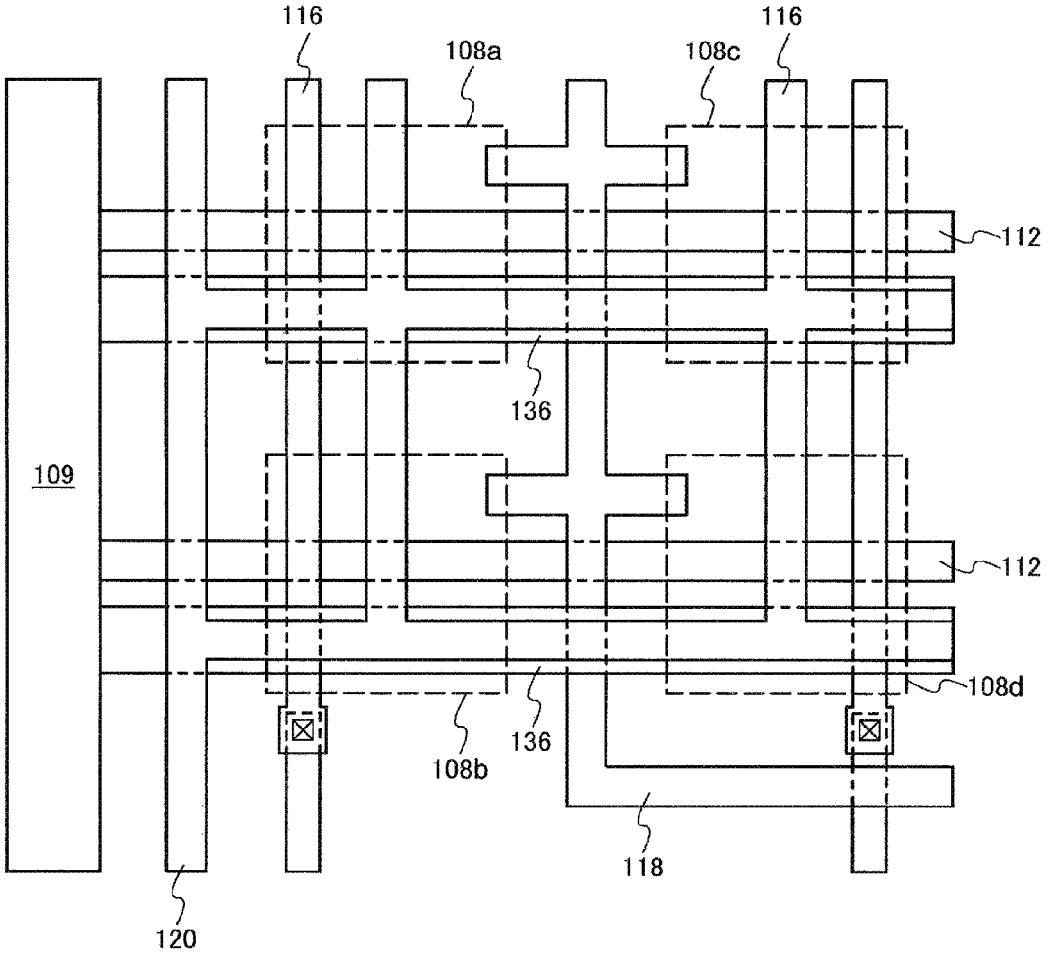
FIG. 10 is a planar view diagram for explaining a structure of wiring arranged in a pixel region of a display device related to one embodiment of the present invention.

FIG. 10 shows a form wherein a conducting layer 136 arranged at an intersection part between the first power source line 118 and second power source line 120 is directly connected to a power source of the first drive circuit 109. By arranging the conducting layer 136 along the second power source line 120, it is possible to detect insulation defects in an intersection part not only with the first power source line 118 but also with the video signal line 116. As is shown in FIG. 10, by directly connecting the conducting layer 136 to a power source of the first drive circuit 109, it is possible to not arrange a contact in the pixel region 106. Furthermore, in this case, the same scanning signal (VGH/VGL) as the first scanning signal line 112 does not have to be applied to the conducting layer 136. Alternatively, the conducting layer 136 may also be applied with a voltage between a first power source voltage (PVH) and a second power source voltage (PVL) from a power source. When a voltage in an intermediate zone between a first power source voltage and second power source voltage is applied to the conducting layer 136, in the case where a short circuit occurs between the first power source line 118 and second power source line 120, it is possible to securely detect a short circuit current.

According to the structure shown in FIG. 10, it is no longer necessary to arrange a contact between the conducting layer 136 and the first scanning signal line 112 between pixels and narrow a pixel pitch which is effective for achieving high definition.

6. Structure of Pixel Region (4)

Figure 11:
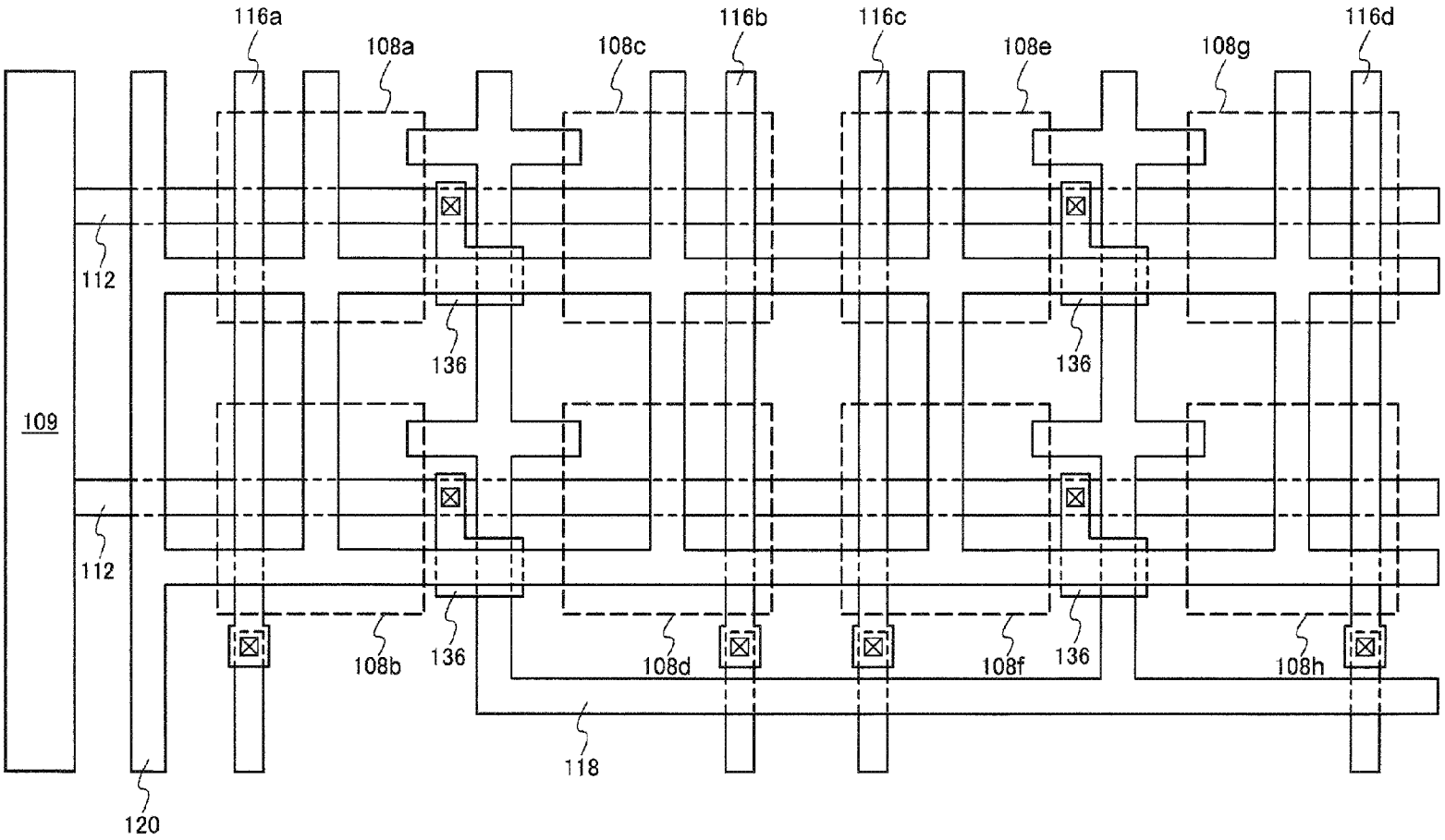
FIG. 11 is a planar view diagram for explaining a structure of wiring arranged in a pixel region of a display device related to one embodiment of the present invention.

FIG. 11 shows a form wherein adjacent video signals in the structure of a pixel region 106 are formed in different layers sandwiching an insulation layer. In FIG. 11, a first video signal line 116*a* is arranged in a first pixel 108*a* and second pixel 108*b*, a second video signal line 116*b* is arranged in a third pixel 108*c* and fourth pixel 108*d*, a third video signal line 116*c* is arranged in a fifth pixel 108*e* and sixth pixel 108*f*, and a fourth video signal line 116*d* is arranged in a seventh pixel 108*g* and eighth pixel 108*h* respectively. Among these, at least the adjacent second video signal line 116*b* and third video signal line 116*c* are arranged in different layers sandwiching an insulation layer.

Conducting layers 136*a*-136*d* are arranged at intersection parts between the first power source line 118 and second power source line 120. Specifically, a first conducting layer 136*a* is arranged between the first pixel 108*a* and third pixel 108*c*, a second conducting layer 136*b* is arranged between the second pixel 108*b* and fourth pixel 108*d*, a third conducting layer 136*c* is arranged between the fifth pixel 108*e* and eighth pixel 108*h*, and a fourth conducting layer 136*d* is arranged between the sixth pixel 108*f* and eighth pixel 108*h*. As is shown in FIG. 4, the conducting layers 136*a*-136*d* are arranged between the second insulation layer 134 and third insulation layer 138.

At least one of either the second video signal line 116*b* and third video signal line 116*c* in the structure of the pixel region 106 shown in FIG. 11 can be arranged above the same insulation layer as the conducting layers 136*a*-136*d*. In this way, it is possible to arrange the second video signal line 116*b* and third video signal line 116*c* in different layers sandwiching an insulation layer. As is shown in FIG. 4, two layers, that is, the second insulation layer 134 and third insulation layer 138, are necessary in order to arrange a conducting layer 136 between the first power source line 118 and second power source line 120. However, by arranging the adjacent second video signal line 116*b* and third video signal line 116*c* in different layers using the second insulation layer 134, it is possible to prevent short circuits between adjacent video signal lines. In other words, by arranging one of either the second video signal line 116*b* and third video signal line 116*c* above the same insulation layer as the conducting layers 136*a*-136*d*, it is possible to prevent short circuits between adjacent video signal lines.

According to the present embodiment, although it is necessary to stack and arrange a plurality of insulation layers in order to arrange and overlap a conducting layer between the first power source line 118 and second power source line 120, by using stacked layers of these insulation layers it is possible to prevent short circuits between adjacent video signal lines.

7. Structure of Pixel Region (5)

Figure 12:
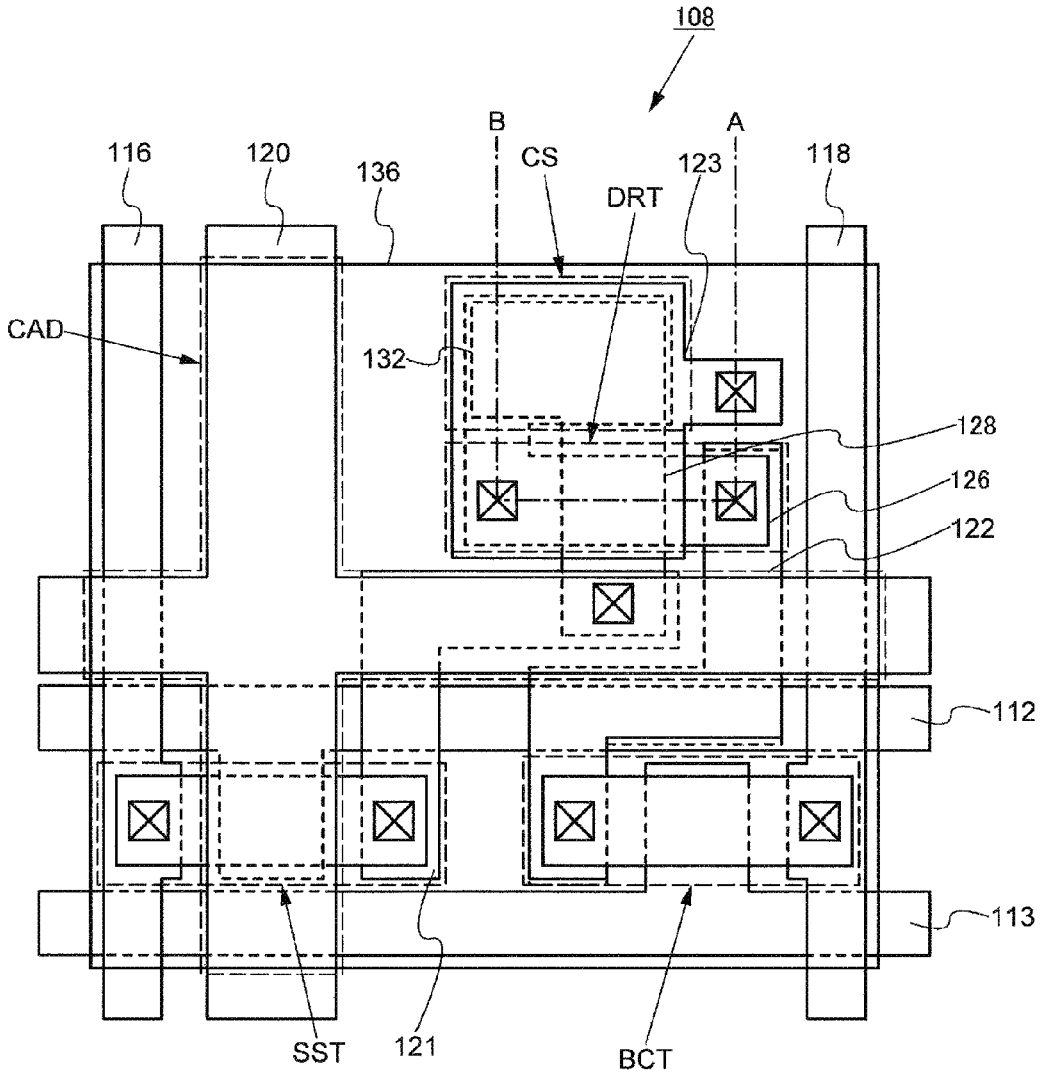
FIG. 12 is a planar diagram showing a pixel layout of a display device related to one embodiment of the present invention.

FIG. 12 is a planar view diagram showing a pixel layout. In FIG. 12, the second power source line 120 is arranged overlapping a pixel electrode 144 via the fourth insulation layer 142 (see also the cross-sectional structure shown in FIG. 4). In addition, an intersection part between the first power source line 118 and second power source line 120 is included in a region overlapping the pixel electrode 144. The current detection portion 160 shown in FIG. 7 may be connected to the second power source line arranged in a layer further above the first power source line 118 and monitors a current value. In addition, when a current above a certain value is detected in the current detection portion 160, the operation of the display device 100 may be terminated according to the same process as FIG. 8. According to this structure, it is possible to omit a conducting layer arranged between the first power source line 118 and second power source line 120. In addition, it is also possible to detect a short circuit between the second power source line 120 (and second capacitor electrode 140) and pixel electrode 144.

In this way, according to the structure of the pixel shown in FIG. 12, it is possible to detect insulation defects not only between a first power source line and second power source line but also between a pixel electrode and an electrode which forms an auxiliary capacitor.

What is claimed is:

1. A display device comprising:

a pixel region includes a plurality of pixels arranged in a matrix;

a first power source line arranged in the pixel region and provided with a first power source voltage supplying a current to the plurality of pixels;

a second power source line located in a layer higher than the first power source line in the pixel region and including an intersection part intersecting the first power source line and provided with a second power source voltage different to the first power source voltage;

a conducting layer interposed between the first power source line and the second power source line via an insulation layer and having at least one part overlapping the intersection part;

a current detection portion electrically connected with the conducting layer; and a switch portion to cut off the connection between the first power source line and a first power source or a connection between the second power source line and a second power source when a current above a certain value is detected in the current detection portion.

2. The display device according to claim 1, wherein the current detection portion outputs a signal for blocking a connection between the second power source line and the second power source in the switch portion when a current above a set threshold value is detected.

3. The display device according to claim 1, wherein the pixel region includes a scanning signal line arranged in a row direction and a video signal line arranged in a column direction and the conducting layer is electrically connected with the scanning line.

4. The display device according to claim 3, further comprising:

a scanning circuit including a positive power source and a negative power source and outputting a scanning signal to the scanning signal line, the conducting layer connected to either the positive power source or the negative power source.

5. The display device according to claim 4, wherein a voltage of the positive power source is higher than a voltage of the first power source and a voltage of the second power source, and a voltage of the negative power source is lower than a voltage of the first power source and a voltage of the second power source.

6. The display device according to claim 3, wherein the conducting layer is arranged along the second power source line and is connected at one end of the scanning signal line.

7. The display device according to claim 1, wherein the conducting layer is provided with a voltage between a voltage of the first power source and a voltage of the second power source.

8. The display device according to claim 1, wherein the conducting layer arranged along the second power source line.

9. The display device according to claim 8, wherein the conducting layer is continuous across a plurality of pixels.

10. The display device according to claim 1, wherein each of the plurality of pixels including a light emitting element, the light emitting element including an organic electroluminescence material.

11. A display device comprising:

a pixel region includes a plurality of pixels arranged in a matrix;

a first power source line arranged in the pixel region and provided with a first power source voltage supplying a current to the plurality of pixels;

a second power source line located in a layer higher than the first power source line in the pixel region and including an intersection part intersecting the first power source line via a first insulation layer and provided with a second power source voltage different to the first power source voltage;

a pixel electrode arranged in a pixel and electrically connected to the first power source line via a transistor and having a region overlapping the second power source line via a second insulation layer;

a current detection portion electrically connected with the second power source line; and a switch portion to cut off the connection between the first power source line and a first power source when a current above a certain value is detected in the current detection portion.

12. The display device according to claim 11, wherein the current detection portion outputs a signal for blocking a connection between the first power source line and the first power source in the switch portion when a current above a set threshold value is detected.

13. The display device according to claim 11, wherein at least one part of the pixel electrode overlaps the intersection part.

14. The display device according to claim 11, wherein each of the plurality of pixels including a light emitting element, the light emitting element including an organic electroluminescence material.

* * * * *